US008390477B2

(12) United States Patent
Noel, II

(10) Patent No.: US 8,390,477 B2
(45) Date of Patent: Mar. 5, 2013

(54) SPACE MONITORING DETECTOR

(76) Inventor: Phares A. Noel, II, Detroit, MI (US)

( * ) Notice: Subject to any disclaimer, the term of this patent is extended or adjusted under 35 U.S.C. 154(b) by 758 days.

(21) Appl. No.: 12/449,711

(22) PCT Filed: Nov. 13, 2007

(86) PCT No.: PCT/US2007/084572

§ 371 (c)(1),
(2), (4) Date: Aug. 24, 2009

(87) PCT Pub. No.: WO2008/061099

PCT Pub. Date: May 22, 2008

(65) Prior Publication Data

US 2010/0026521 A1 Feb. 4, 2010

Related U.S. Application Data

(60) Provisional application No. 60/865,568, filed on Nov. 13, 2006.

(51) Int. Cl.
*G08G 1/01* (2006.01)
*G08G 1/042* (2006.01)
*G08B 13/24* (2006.01)

(52) U.S. Cl. ..... 340/941; 340/932.2; 340/933; 340/934; 340/568.1

(58) Field of Classification Search ..... 340/907, 340/917, 932.2, 933, 938, 939, 941; 324/236, 324/239

See application file for complete search history.

(56) References Cited

U.S. PATENT DOCUMENTS

| | | | | |
|---|---|---|---|---|
| 3,651,452 | A * | 3/1972 | Friedman | 340/938 |
| 3,685,013 | A * | 8/1972 | Brickner | 340/939 |
| 5,247,297 | A * | 9/1993 | Seabury et al. | 340/941 |
| 6,417,784 | B1 * | 7/2002 | Hilliard et al. | 340/941 |
| 6,456,067 | B1 * | 9/2002 | Ward | 324/236 |
| 6,771,064 | B2 * | 8/2004 | Leibowitz et al. | 324/207.15 |

* cited by examiner

*Primary Examiner* — George Bugg
*Assistant Examiner* — Anne Lai
(74) *Attorney, Agent, or Firm* — Singh Law Firm, PLLC; Gautam B. Singh

(57) ABSTRACT

Disclosed is an inventory control system or parking space detector including an inductive loop technology that is either embedded in the concrete or located atop the concrete, or any other feasible method of setting an inductive loop. By monitoring the change in inductance of the magnetic field that is generated by the loop as cars of various sizes and weights enter the looped area, a determination of whether or not the inventory is controlled or the parking spaces are all full is made when the inductance value reaches a certain predetermined level. This predetermined level will be determined by calibration in the initial installation in order to determine the exact inductance values when a group of parking spaces are full.

20 Claims, 2 Drawing Sheets

SPACE MONITORING DETECTOR

COPENDING PATENT APPLICATION

This patent application claims the priority of copending provisional patent application No. 60/865,568 filed Nov. 13, 2006 in the United States Patent Office.

TECHNICAL FIELD

The many aspects of this invention relate generally to inventory control, and more particularly, one aspect relates to a parking space detector that will signal a driver coming into a parking lot or parking garage as to whether or not a parking space is available for their car.

BACKGROUND OF THE INVENTION

Inventory control is important to any business, and is especially important to inventories of vehicles, as they can be driven away at any time. Car lots, construction equipment yards, and even hospital equipment storage rooms could be better managed if the person in charge knew where the inventory was. Just knowing whether or not everything is put away in its proper place can be a critical piece of information. Even though inventory control is a very important aspect of many businesses, in this application, we look at one special aspect, the aspect of the last remaining parking space, even though the principles of inventory control work equally well for any inventory control application.

At one time or another, nearly every driver in an urban area has experienced the anguish of looking for a parking space in a highly crowded parking lot, above ground parking deck, multi-level below ground parking lot, or the like. Since there is no way to visually assess whether or not there is a parking space available, and the parking garage operator does not have any way of telling you whether or not there's an empty space, your only option is to drive through all of the aisles and look for an available parking space.

Who hasn't gone to the airport and looked for a long period of time for an available parking space while the minutes are ticking away towards the departure of your airplane? Anyone who has had this experience knows that it would be a great advantage if a system existed that would indicate whether or not at least one parking space was available out of all of the parking spaces in the lot or garage.

It would be also desirable for such a system to have a signaling system of some sort, whether it is a system similar to a red/green traffic light or an electronic message sign that would alert drivers entering a parking facility to whether or not an available parking space exists. For example, if all the spaces were full, an indicator light would appear as a "red" or a message sign would indicate full. In the event that there were available spaces, the indicator light would show "green" or "OPEN" for a message sign, which would indicate to the driver that there was an available spot. The person would be guided to the level and then subsequently to the row where the available space is located by the green indicator signs. An additional feature of the system would have an indicator display that would also tell you the number of available space (s) as well as the location of the parking space that was available.

In the past, more complicated conventional parking lot and garage systems have been utilized for automatic parking director systems in order to signal available parking spaces. Some have even showed displays which indicate the exact open parking space. These "intelligent parking garages" have been studied for many years and several have arisen, but at a very high cost. Such systems are able to detect the presence and/or absence of a vehicle in a particular parking space in a parking lot having a plurality of parking spaces, identifying the space location that is available for use and automatically providing the location to the prospective user in short order.

By the way of example, we now look to U.S. Pat. No. 7,026,954 issued Apr. 11, 2006 to Slemmer et al. and assigned to Bell South Intellectual Property Corporation of Wilmington, Del. Although the system would surely be reliable, it involves the use of individual sensors at each parking space, and therefore the cost is too high for most parking garages. This prior art invention includes a plurality of serially connected sensors/detectors for each parking space working in conjunction with a radio transmission tower, or internet communication device, along with all the problems that those devices exhibit. Due to the expense and extreme complexity of this system, the Bell South IP Corp. system has not found great utility in the United States.

In other attempts to solve this problem, The University of Wisconsin, Madison Campus Transportation Society has been interested in this problem for several years, and has published various papers which disclose further sensors, microsensors, custom dash developed communication systems, and the like, although none of those systems have found great utility in this art area.

Therefore, it would desirable and advantageous to provide a parking space detector or inventory control system which is much lower in cost, and which may or may not identify the individual parking space which is available. Sufficient to say, if a driver is aware that an available parking space is located anywhere within the parking garage, they would be happy to go find it. My invention also includes further embodiments which would be able to be intelligent and discern which of the available parking spaces were empty.

Therefore, my invention discloses a new, advantageous parking space detector or inventory control system which is much lower in cost than the above-mentioned technologies, and which will provide sufficient information to allow a driver to determine whether or not there are available spaces in the parking structure, lot or garage.

SUMMARY OF THE INVENTION

In accordance with the present invention, there is disclosed a parking space detector or inventory control system including an inductive loop technology that is either embedded in the concrete or located atop the concrete, or any other feasible method of setting an inductive loop. By monitoring the change in inductance of the magnetic field that is generated by the loop as cars of various sizes and weights enter the looped area, a determination of whether or not the parking spaces are all full is made when the inductance value reaches a certain predetermined level. This predetermined level will be determined by calibration in the initial installation in order to determine the exact inductance values when a group of parking spaces are full.

Conventional inductive loop detectors can tell whether or not a vehicle is present by measuring the change in inductance caused by the presence of a vehicle within the loop. My invention uses these detectors not only as an on/off switch but as an instrument to measure the change of inductance as increasing numbers of vehicles enter the parking facility and fill the spaces. The change in inductance, or the inductance drop, is achieved with smaller and smaller increments as more and more vehicles enter the parking space. Because of this, it may be difficult to determine when that last illusive parking space is the only one that is available. In that event, an embodiment of the present invention is included to "boost" the inductance signal so that a small change in inductance can easily be determined to allow the system to carry on and give information to a driver about an empty parking space.

Further envisioned is the ability to store a predetermined loop signal by capturing that characteristic at a certain fill level, and then being able to scan and compare this fill level to new parking situations from that point on. When the loop field changes, a signal would be produced indicating vehicle movement. This would be the sentinel node. In yet another embodiment of the present invention, the system would automatically calculate the values to be used in the sentinel mode through either neural nets or some other type of training algorithm. This training algorithm may help the system to quickly learn how the loop field characteristics change with differing numbers and sizes of cars which will be entering the parking lot, structure or garage. Needless to say, a training algorithm could increase the performance of the discrimination circuit in order to provide more accurate information about available parking spaces, in order to be more accurate in determining whether or not the spaces being monitored by the loop are full. Other self-tuning schemes and/or devices may be utilized, in order to supplement preexisting systems, as numerous devices may be incorporated.

Although the invention will be described by way of examples hereinbelow for specific embodiments having certain features, it must also be realized that minor modifications that do not require undo experimentation on the part of the practitioner are covered within the scope and breadth of this invention. Additional advantages and other novel features of the present invention will be set forth in the description that follows and in particular will be apparent to those skilled in the art upon examination or may be learned within the practice of the invention. Therefore, the invention is capable of many other different embodiments and its details are capable of modifications of various aspects which will be obvious to those of ordinary skill in the art all without departing from the spirit of the present invention. Accordingly, the rest of the description will be regarded as illustrative rather than restrictive.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE INVENTION

Figure 1:
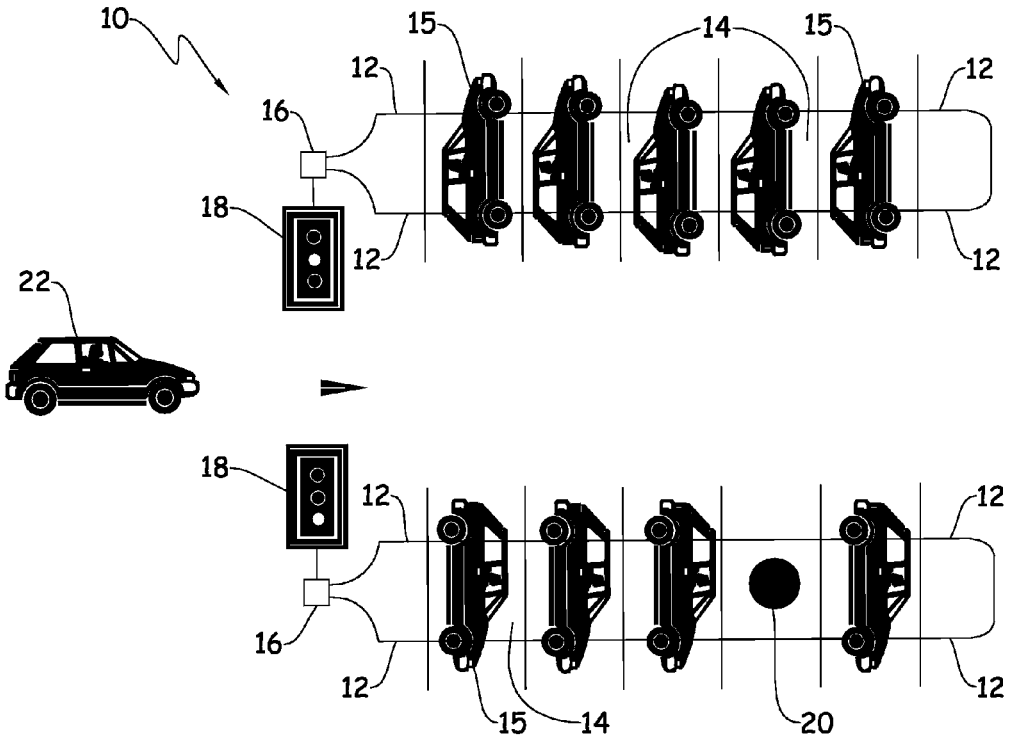
FIG. 1 shows a schematic diagram of an inductive loop assembly made in accordance with the present invention.

By way of general description, the present invention is an inexpensive means for detecting parking spaces that remain empty in a nearly full parking lot, structure or garage. However, the present invention may also be used to tell when a car has left the premises, which is important for inventory control for automobile dealers, construction equipment lots, hospitals using equipment, and any other inventory control means that is necessary. Although the emphasis of this patent application and my invention has been on parking space detection, do not misunderstand that this system is also an inexpensive means for effecting other types of inventory control in a cost effective, number specific method.

As one of ordinary skill in the art can imagine, although it is the inductive loop assembly system of the present invention that may be used to tell when a system is filling up, it may also be used in the reverse to determine when a parking lot is emptying out. For example, large parking lots, such as automobile dealer lots routinely "lose" cars off their inventory lots without their knowledge and cars are stolen off employee parking lots even sometimes while they're under surveillance. If they knew the number of inventory cars was decreasing because someone was stealing one of their cars, they might be able to lock gates and prevent egress from the lot where they were storing the cars. This is an everyday occurrence where cars are stolen from auto dealer lots. In addition, construction equipment inventory control would also be important. Workers in the construction field are aware that as they arrive early in the morning to retrieve their pieces of construction equipment, many times those pieces have been stolen and therefore they are not available to work on the days job. Needless to say, this puts their work at a halt until they can find a like piece of equipment.

Another aspect of the present invention finds utility even in the field of hospital equipment. Many hospital workers have experienced the sinking feeling of looking for an EKG machine in their department, only to find that someone from another department has "taken" their piece of equipment for their own use in another department. Furthermore, those pieces of equipment are generally "parked" in a single area or room, where a stock room of equipment is designated. The present invention of the inductive loop would also determine whether or not the pieces of equipment were located in the stock room at the end of a shift. If a piece of equipment was meant to be removed, a password or some other department-specific system could be utilized to prevent the removal of equipment from that stock room without authorization.

Therefore, although the emphasis has been on parking space detection, the scope of the present invention is much greater, and is only to be limited by the imagination of ordinary skill in the art after reading this patent application. Many of these applications can be implemented without undue experimentation, and great utility could be realized with such an inexpensive system. Therefore, now that we have discussed the general applications and show that they are too numerous to disclose here, we will focus our attention on an exemplary parking space detection issue, as follows.

As shown in FIG. 1, and as disclosed hereinabove, the present invention may be used to detect whether or not any remaining parking space(s) is still available in a parking lot, structure or garage. Shown is an inventory control system generally denoted by the numeral 10 as shown in FIG. 1. An inductive loop detector 12 may be used for detection of the presence or absence of the $n^{th}$ vehicle, where (n) is the number of spaces being monitored. Inductive loop 12 may be installed into the floor of the parking facility during construction or may be added after construction has taken place.

Referring still to FIG. 1, an inductive loop coil 12 is placed in the floor of the parking facility in such a way that the loop intersects all parking spaces 14 and that all cars 15 entering these spaces will alter the loops magnetic field. Electronic loop detector system 16 measures the interaction of the individual vehicles 15 and the loops magnetic field, and signals an indicator 18 for display of the resulting data. Indicator 18 is shown as a simulated traffic light to indicate either a "red" indicia meaning that the loop is full, as is shown in the top loop of FIG. 1, or it may indicate a "green" indicia meaning that the loop is not full yet, and there is an empty parking space 20 as shown in the bottom loop of FIG. 1. Any other suitable indicia of "full" or "available" is envisioned.

Therefore, in this aspect, a driver 22 looking for a parking space would enter into the parking facility and would drive right past the simulated traffic light 18. If the light was "red", then the driver 22 would know that there were no more parking spaces available, and would drive to another parking lot. However, if the light 18 showed a "green" light, the driver would enter the parking garage to look for the available spot 20.

Although FIG. 1 illustrates the use of the inductive loop in a parking garage, and shows a schematic diagram indicating an example of the system response to a monitored area where space is available, other inventory control applications may require the exact opposite interpretation of data. Where the top inductive loop row of FIG. 1 indicates a full row and the bottom loop indicates a monitored area where a space is available, other inventory controls need to know when the lot is not full anymore. The same analysis needs to be done, but in the reverse. This is a matter of changing the indicia triggering response from a "one left" scenario to a "minus one" scenario for indicating the needed information.

For very large loops in this aspect of the invention, the change in inductance between a full loop and one with just one available space may be so small, the loop detector may have difficulty detecting this small change due to its level of sensitivity. To overcome this issue, my invention may include the use of an optional boost electronic mechanism to increase the signal level at a predetermined lower level to a level above its lower threshold of sensitivity to allow for easier discernment of the change in the signal value. Once the signal level has been boosted to a large enough value for detection, the system may trigger. Further, my invention may optionally add a signal boost scheme to aid in differentiating smaller diminishing signals as more and more cars enter a monitored space.

Figure 2:
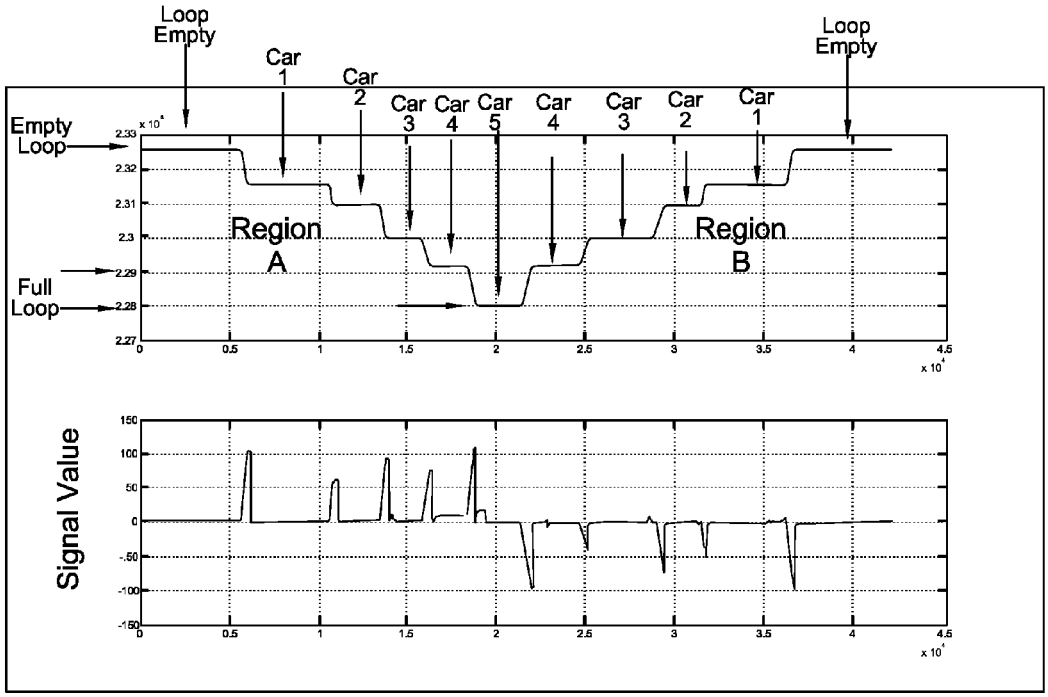
FIG. 2 is an example graph indicating the change in the loop characteristics as 5 cars enter and exit the loop in sequential order.

FIG. 2 is a graph of signal value versus number of cars entering the monitored spaces, in which it is shown that the relevant drop in signal level indicates how many cars are in the monitored parking spaces. The signal level drop at the middle of the graph illustrates when there is a transition from having one empty space left to having no empty spaces available. Although this graph appears to be plotted on a linear scale, in which the decrease in signal value appears to be uniform, in actuality, the drop becomes an incrementally smaller and smaller value. A "boost" to raise the signal levels for determination and switching purposes may be provided to reliably feed data input into the electronic processor 16 of FIG. 1.

As shown in FIG. 2, as an example during the normal course of parking garage operation, cars 1 through 5 will enter (Region A) and exit (Region B), so the inductive loop detector 10 will exhibit a signal level of an inductance level of lower and lower values, as cars enter into and fill the loop. Each car causes a subsequent change in the magnetic field generated by the loop detector due to the fact that typical vehicles are made of metal, and the inductive loop will respond correspondingly. Some inductive loops that may be used for the present invention will detect a large metal object in the cell 14 due to a magnetic deviation. Other suitable loops used for other inventory control may be calibrated to a different signal, depending upon the application. Then, as cars 1 through 5 exit in Region B, the signal value increases until the loop is empty again.

My invention may utilize an inductive loop detector which can monitor the change in inductance of the magnetic field that is generated by the loop as individual cars enter the loop as the parking spaces begin to fill. By monitoring the inductance and determining whether the parking spaces are all full, various signals can be generated and displayed in order to provide space availability information for future drivers as they enter the parking garage.

For example, if a single empty parking space is detected as being available, an indicator light, similar to a traffic light or any other type of indicator sign that is familiar to drivers can be utilized. It is envisioned by the inventor that a signal light system could be utilized using red and green lights to indicate whether or not a space is available in the monitored area. A green light could indicate that a driver can enter and thereafter either find the available space, or in the event of the use of another embodiment of my invention, a display could indicate which space is available for parking.

In another embodiment of the present invention, the boost option regulates the signal strength in an ever-decreasing signal level situation. Once the boost occurs, the signal level is significant enough as to allow an easier determination for a switching value which may be used to control a subsequent signaling device utilized in the parking facility, i.e. Red/Green signaling system.

A boosted signal delineates the differences between the inductance level of "n" number of units and the "n+1" number of units in place. Of course, sufficiently sensitive equipment and meters may obviate the need for the boost option.

Calibration and Installation

Installing an inductive loop in accordance with the present invention involves either including the inductive loop in the original concrete that is laid down during the construction of such a parking lot, structure or garage, or retrofitting by embedding the inductive loop into the floor of the parking facility after it has been constructed. The loop may also be installed on the surface of the parking area for temporarily monitoring spaces in a situation where monitoring of spaces is only needed on a temporary basis. i.e. monitoring of mobile construction equipment at a temporary job site. The method of installation will depend upon the exact configuration of the parking lot, structure or garage, and those determinations must be made at the time of installation.

Calibration may be achieved by utilizing a tuning algorithm that can be preset with a starting value which represents a full loop, such as when a parking lot is full of cars. This initial value will eventually be determined over time as more of these systems are installed and more data has been gathered on the ranges of values for full loops for a particular length and configuration. In other words, if a parking lot in a small town has parking spaces for 80 cars, the preset value will be different than for an airport parking lot where they have parking spaces for 500 vehicles. Although the initial value can be determined by monitoring the vehicles as they enter the loop one by one until the loop is full during an initial installation of this technology, the tuning algorithm can be developed and deployed over time as those values become evident.

It is also a possibility that there may be more than one sub-grid as there may be limitations on the maximum or optimal loop length that can be reasonably achieved. The limitations of these systems can be determined by a calibration scheme whereby the loop must first be filled with cars and then switching them around, in various configurations in addition to moving them in and out one at a time inside the monitored parking spaces in order to determine what the maximum number of vehicles that can be monitored within a single loop. It is envisioned that multiple loops will be needed to monitor a single row of vehicles. The actual number of loops that will be needed will have to be determined on a case by case basis. In this scenario where multiple loops are necessary for monitoring a single row, the signals from the individual loop monitors will be combined logically to perform as one large loop. An example would be when two loops are needed to monitor one row. When both monitors indicate that the spaces they are monitoring are full, the final state that would be sent to the visible signal indicator would be that there are no available spaces in that row. The Boolean arithmetic expression for this sequence of operation is a logical AND. The following is a truth table which demonstrates the operation of two detectors monitoring one row.

| Loop # 1 Full | Loop #2 Full | Row Full |
|---|---|---|
| T | T | T |
| F | T | F |
| T | F | F |
| F | F | F |

In addition, the inventor envisions that this type of observation will yield differing readings with characteristics evident in different levels of loop values commensurate with various combinations of cars, which may vary by their weights and metallic content. For example, a Corvette, having an entirely composite construction, would have a different value from a Cadillac Escalade, which is made entirely of metal. The magnetic field generated by the loop will of course be more effected by an all metal car than it will be by a fiberglass or aluminum vehicle. These values, that are utilized by the Boolean logic, that determine what precise point the spaces that are monitored by the loop detector are full will have to be determined by experimentation in which the tuning algorithm will be utilized to speed the development of those values. In order to generate this range of values for a full loop of a certain length η, with a certain combination of vehicles $V_c$, where c identifies the specific combination of vehicles:

Average full loop indicating value for a particula loop length = $A_\eta$

Loop value for a particular combinations of cars in a parking section of length $\eta = L_c$ Particular combinations of the same group of cars = $c$ $$A_\eta = \frac{\sum_{x=1}^{c} L_c}{C} = \text{Average full loop indicating value of length for a particular combination of cars}$$

This equation will determine the average full loop indicating value for a particular loop configuration, for a particular combination of cars. During installation, this combination of vehicles would be monitored by a loop monitoring system and that will determine the average full loop indicating value that is needed for calibration of the system. At that point, the system will be ready to go to instruct drivers about whether or not there is a parking space left when they enter the lot, structure or garage.

In summary, numerous benefits have been described which result from employing any or all of the concepts and the features of the various specific embodiments of the present invention, or those that are within the scope of the invention. The loop monitoring system performs this task perfectly.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated.

INDUSTRIAL APPLICABILITY

The present invention finds industrial applicability with regards to inventory control systems, and finds particular utility with parking garage and parking lot space management.

What is claimed is:

1. A space monitoring detector comprising:

an inductive loop spanning a plurality of storage spaces wherein each of the plurality of spaces can accommodate an object from a collection of objects of nonuniform size and weight;

a predetermined threshold inductance value associated with occupancy of all of the plurality of spaces spanned by the inductive loop;

an electronic processor for measuring an aggregate loop inductance value;

a processing step of comparing the measured aggregate loop inductive value with a predetermined threshold inductance value to determine when all of the plurality of monitored spaces are occupied.

2. A space monitoring detector of claim 1 wherein the predetermined threshold inductance associated with occupancy of all of the plurality of spaces spanned by the inductive loop is a sum of a predetermined average inductance value associated with the occupancy of each of the plurality of spaces with objects from the collection of objects of nonuniform size and weight.

3. A space monitoring detector of claim 2 wherein the average predetermined inductance value associated with the occupancy of each of the plurality of spaces with an object of nonuniform size and weight is $A_\eta$ where $A_\eta$ is obtained using the equation $$A_\eta = \frac{\sum_{x=1}^{c} L_x}{c}$$

wherein $L_x$ is the inductance of an object x in a collection of c objects of nonuniform size and weight.

4. The detector system of claim 2, where the loop inductance characteristic is determined using a self-tuning process wherein the measured aggregate loop inductance is used to recalibrate the average predetermined inductance value associated with occupancy of each of the plurality of spaces with objects from the collection of objects of nonuniform size and weight.

5. A space monitoring detector of claim 1 wherein the processing step used for comparing the measured aggregate loop inductive value with a predetermined threshold inductance value utilizes a training algorithm.

6. A space monitoring detector of claim 1 wherein the processing step used for comparing the measured aggregate loop inductive value with a predetermined threshold inductance value utilizes a neural network.

7. The detector system of claim 1, further comprising a signal booster for boosting the relevant drop in signal level to raise a signal level for determination and switching purposes.

8. A space monitoring detector of claim 1 adapted for use in a parking lot wherein the inductive loop spans a plurality of parking spaces and is adapted to detect when all of the plurality of parking spaces are occupied with vehicles from a collection of vehicles of nonuniform size and weight.

9. A space monitoring detector of claim 8 wherein a unique predetermined inductance value is associated with occupancy of each of the plurality of parking spaces by a vehicle from the collection of vehicles of nonuniform size and weight.

10. A space monitoring detector of claim 9 wherein the unique predetermined inductance value associated with the occupancy of each of the plurality of spaces with an object of nonuniform size and weight is $A_\eta$ where $A_\eta$ is obtained using the equation $$A_\eta = \frac{\sum_{x=1}^{c} L_x}{c}$$

where $L_x$ is the inductance of a vehicle x in a collection of c vehicles of nonuniform size and weight.

11. A space monitoring detector of claim 1 adapted for use in monitoring hospital equipment storage wherein the inductive loop spans a plurality of hospital equipment storage spaces and is adapted to detect when all of the plurality of hospital equipment storage spaces are occupied with hospital equipment from a collection of hospital equipment of nonuniform size and weight.

12. A space monitoring detector for determining a level of occupancy of a plurality of spaces in a controlled area comprising:

an inductive loop spanning a plurality of storage spaces wherein each of the plurality of spaces can accommodate an object from a collection of objects of nonuniform size and weight;

a predetermined inductance value associated with an occupancy of each of the plurality of spaces with a predetermined object;

an electronic processor for measuring an aggregate loop inductance value;

a processing step of comparing the measured aggregate loop inductive value with a plurality of predetermined threshold inductance values to determine a level of occupancy of the plurality of spaces.

13. A space monitoring detector of claim 12 wherein the predetermined threshold inductance associated with occupancy of all of the plurality of spaces spanned by the inductive loop is a sum of a predetermined average inductance value associated with the occupancy of each of the plurality of spaces with objects from the collection of objects of nonuniform size and weight.

14. A space monitoring detector of claim 13 wherein the unique predetermined inductance value associated with the occupancy of each of the plurality of spaces with an object of nonuniform size and weight is $A_\eta$ where $A_\eta$ is obtained using the equation $$A_\eta = \frac{\sum_{x=1}^{c} L_x}{c}$$

wherein $L_x$ is the inductance of an object x in a collection of c objects of nonuniform size and weight.

15. A space monitoring detector of claim 12, further comprising a signal booster for boosting the relevant drop in signal level to raise a signal level for determination and switching purposes.

16. A space monitoring detector of claim 12 adapted for use in measuring a level of occupancy of a plurality of parking spaces in a parking lot wherein the inductive loop spans the plurality of parking spaces and is adapted to measure the level of occupancy of the plurality of parking spaces wherein vehicles from a collection of vehicles of nonuniform size and weight are parked.

17. A space monitoring detector of claim 16 wherein a unique predetermined inductance value is associated with the occupancy of each of the plurality of parking spaces by a vehicle from the collection of vehicles of nonuniform size and weight.

18. A space monitoring detector of claim 17 wherein the unique predetermined inductance value associated with the occupancy of each of the plurality of spaces with an object of nonuniform size and weight is $A_\eta$ where $A_\eta$ is obtained using the equation $$A_\eta = \frac{\sum_{x=1}^{c} L_x}{c}$$

where $L_x$ is the inductance of a vehicle x in a collection of c vehicles of nonuniform size and weight.

19. A space monitoring detector of claim 12 adapted for use in measuring a level of occupancy of a plurality of hospital equipment storage spaces wherein the inductive loop spans the plurality of hospital equipment storage spaces and is adapted to measure the level of occupancy of the plurality of hospital equipment storage spaces that store hospital equipment from a collection of hospital equipment of nonuniform size and weight.

20. A space monitoring detector comprising:

of a plurality of inductive loops wherein each of the plurality of inductive loops spans a plurality of storage spaces where each of the plurality of spaces can accommodate an object of nonuniform size and weight, and a predetermined threshold inductance value is associated with an occupancy of all of the plurality of spaces spanned by inductive loop;

an electronic processor for determining an aggregate inductance measure for each loop in the plurality of inductive loops;

a processing step of comparing the aggregate inductance measure with the predetermined threshold inductance value to determine when each of the plurality of spaces spanned by the inductive loop are occupied; and a boolean function to determine when all of the plurality of spaces spanned by all of the plurality of inductive loops are occupied.

* * * * *